US007147502B1

(12) United States Patent
Wu

(10) Patent No.: US 7,147,502 B1
(45) **Date of Patent: *Dec. 12, 2006**

(54) CABLE CONNECTOR ASSEMBLY WITH LATCHING MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/268,906

(22) Filed: Nov. 8, 2005

(51) Int. Cl.
*H01R 13/627* (2006.01)

(52) U.S. Cl. ..... 439/352

(58) Field of Classification Search ..... 439/352, 439/358, 357, 355, 108, 160
See application file for complete search history.

(56) References Cited

U.S. PATENT DOCUMENTS

| | | | | |
|---|---|---|---|---|
| 5,564,939 | A | 10/1996 | Maitani et al. | |
| 5,645,440 | A * | 7/1997 | Tobler et al. | 439/160 |
| 5,660,558 | A * | 8/1997 | Osanai et al. | 439/353 |
| 5,797,771 | A | 8/1998 | Garside | |
| 5,941,726 | A * | 8/1999 | Koegel et al. | 439/358 |
| 6,095,862 | A | 8/2000 | Doye et al. | |
| 6,165,006 | A | 12/2000 | Yeh et al. | |
| 6,257,914 | B1 * | 7/2001 | Comerci et al. | 439/357 |
| 6,319,040 | B1 * | 11/2001 | Chang | 439/352 |
| 6,431,902 | B1 * | 8/2002 | Yeh | 439/358 |
| 6,454,577 | B1 * | 9/2002 | Yi | 439/108 |
| 6,641,425 | B1 * | 11/2003 | Wu | 439/352 |
| 6,648,665 | B1 * | 11/2003 | Wu | 439/352 |
| 6,659,790 | B1 | 12/2003 | Wu | |
| 6,749,458 | B1 | 6/2004 | Kuo et al. | |
| 6,865,369 | B1 * | 3/2005 | Semmeling et al. | 434/357 |
| 6,866,533 | B1 * | 3/2005 | Wu | 439/352 |
| 6,887,091 | B1 * | 5/2005 | Wu | 439/352 |
| 6,887,101 | B1 | 5/2005 | Ito et al. | |
| 2003/0236017 | A1 * | 12/2003 | Waddell et al. | 439/352 |

OTHER PUBLICATIONS

"SFF-8088 Specification for Compact Multilane Series: Shielded" published on Jun. 27, 2005 by SFF Committee.

* cited by examiner

*Primary Examiner*—Tulsidas C. Patel
*Assistant Examiner*—Harshad C Patel
(74) *Attorney, Agent, or Firm*—Wei Te Chung

(57) ABSTRACT

A cable connector assembly (100) for mating with a complementary connector along a front-to-back direction includes a housing (1) defining a receiving space (15) and a top surface, a number of contacts (21, 22) received in the receiving space of the housing, a cable (6) electrically connecting with the contacts, a pulling member (3) assembled to the top surface of the housing and a conductive shell (4) assembled to the housing. The conductive shell includes a body portion (40) essentially vertically shielding the pulling member and a latch member (5) integrally extending from the body portion of the conductive shell. The latch member is capable of being actuated by the pulling member for being deflected in a vertical direction perpendicular to the front-to-back direction, so as to latch or unlatch with regard to the complementary connector.

19 Claims, 7 Drawing Sheets

CABLE CONNECTOR ASSEMBLY WITH LATCHING MECHANISM

CROSS-REFERENCE TO RELATED APPLICATIONS

This application is related to U.S. patent application Ser. No. 11/201,521 filed on Aug. 11, 2005 and entitled "CABLE CONNECTOR ASSEMBLY WITH LATCHING MECHANISM", U.S. patent application Ser. No. 11/201,461 filed on Aug. 11, 2005 and entitled "CABLE CONNECTOR ASSEMBLY WITH LATCHING MECHANISM", and U.S. patent application Ser. No. 11/213,048 filed on Aug. 26, 2005 and entitled "CABLE CONNECTOR ASSEMBLY WITH EMI GASKET", all of which have the same applicant and assignee as the present invention. The disclosure of these related applications is incorporated herein by reference.

BACKGROUND OF THE INVENTION

1. Field of the Invention

The present invention generally relates to a cable connector assembly, and more particularly to a cable connector assembly used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products. Specification SFF-8088 defines matable Compact Multilane Shielded connectors adopted for being used in laptop portable computer to connect small-size disk drives to a printed circuit board. The connectors comprise a cable connector assembly connecting with the small-size drive and a header mounted on the printed circuit board. The cable connector assembly defined in the specification comprises a pair of engageable metal housings together defining a receiving space therebetween, a PCB received in the receiving space, a cable comprising a plurality of conductors electrically connecting with the PCB, and a latching mechanism assembled to a top surface of the upper metal housing. The latching mechanism comprises an elongated T-shape latch member for latching with the header mentioned above and a pulling member cooperating with the latch member for actuating the latch member to separate from the header. The latch member is assembled to a rear portion of a base of the upper housing with latch portion exposed beyond a front portion of the base of the upper housing to locate above a tongue portion of the upper housing. However, such elongated latch member is hard to be actuated by the pulling member, otherwise the latch member must have enough thickness or made by high-quality material having enough rigidity to achieve the goal of latching reliably and unlatching easily.

Hence, an improved cable connector assembly is provided in the present invention to address the problems mentioned above and meet the current trend.

BRIEF SUMMARY OF THE INVENTION

Accordingly, an object of the present invention is to provide a cable connector assembly which can latch with a complementary connector reliably and unlatch from the complementary connector easily.

In order to achieve the above-mentioned object, a cable connector assembly in accordance with the present invention which mates with a complementary connector along a front-to-back direction comprises a housing defining a receiving space and a top surface, a plurality of contacts received in the receiving space of the housing, a cable electrically connecting with the contacts, a pulling member assembled to the top surface of the housing and a conductive shell assembled to the housing. The conductive shell comprises a body portion essentially vertically shielding the pulling member and a latch member integrally extending from the body portion of the conductive shell. The latch member is capable of being actuated by the pulling member for being deflected in a vertical direction perpendicular to the front-to-back direction, so as to latch or unlatch with regard to the complementary connector.

Other objects, advantages and novel features of the invention will become more apparent from the following detailed description of the present embodiment when taken in conjunction with the accompanying drawings.

DETAILED DESCRIPTION OF THE INVENTION

Figure 1:
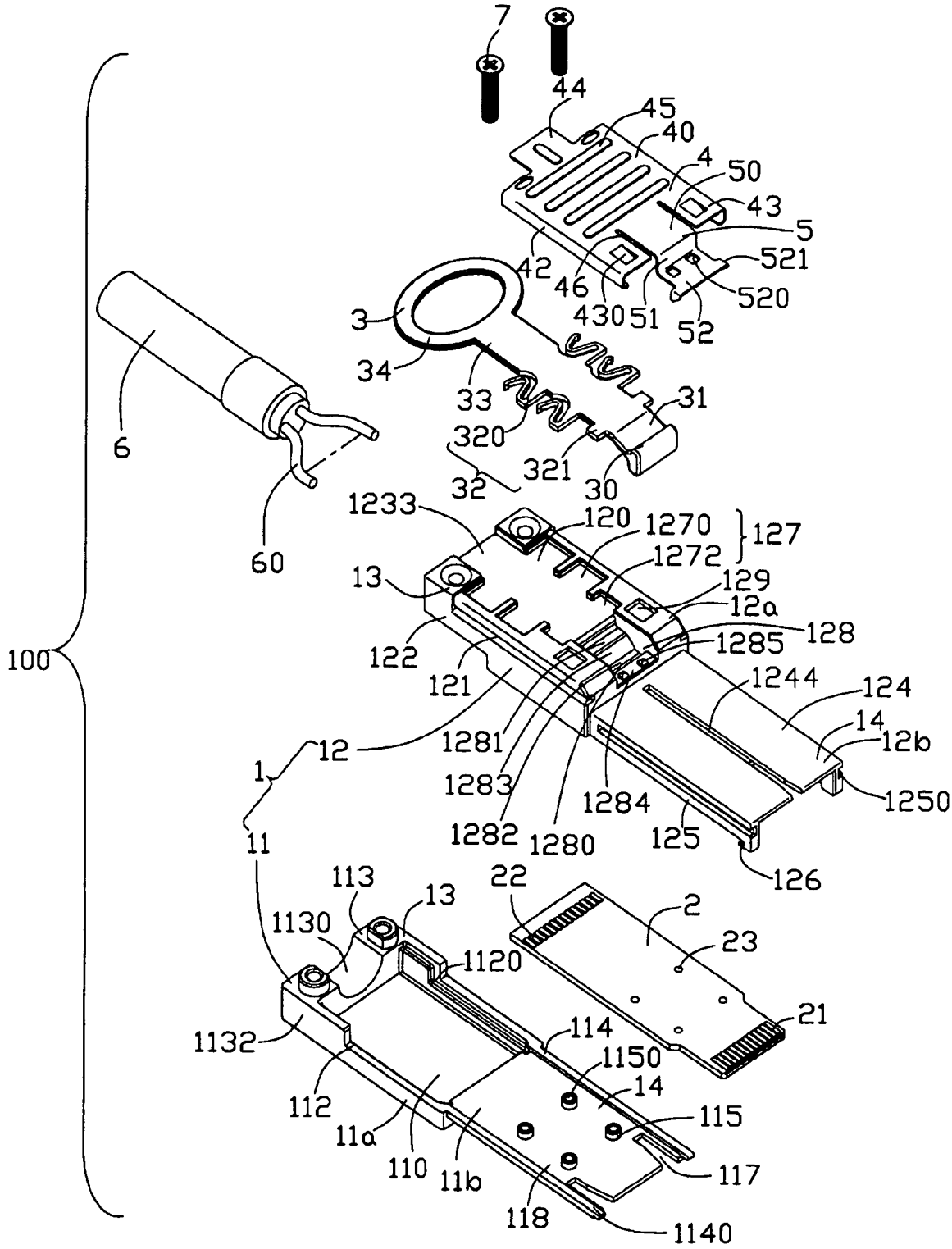
FIG. 1 is an exploded, perspective view of a cable connector assembly in accordance with the present invention.

Reference will now be made to the drawing figures to describe the present invention in detail.

Figure 2:
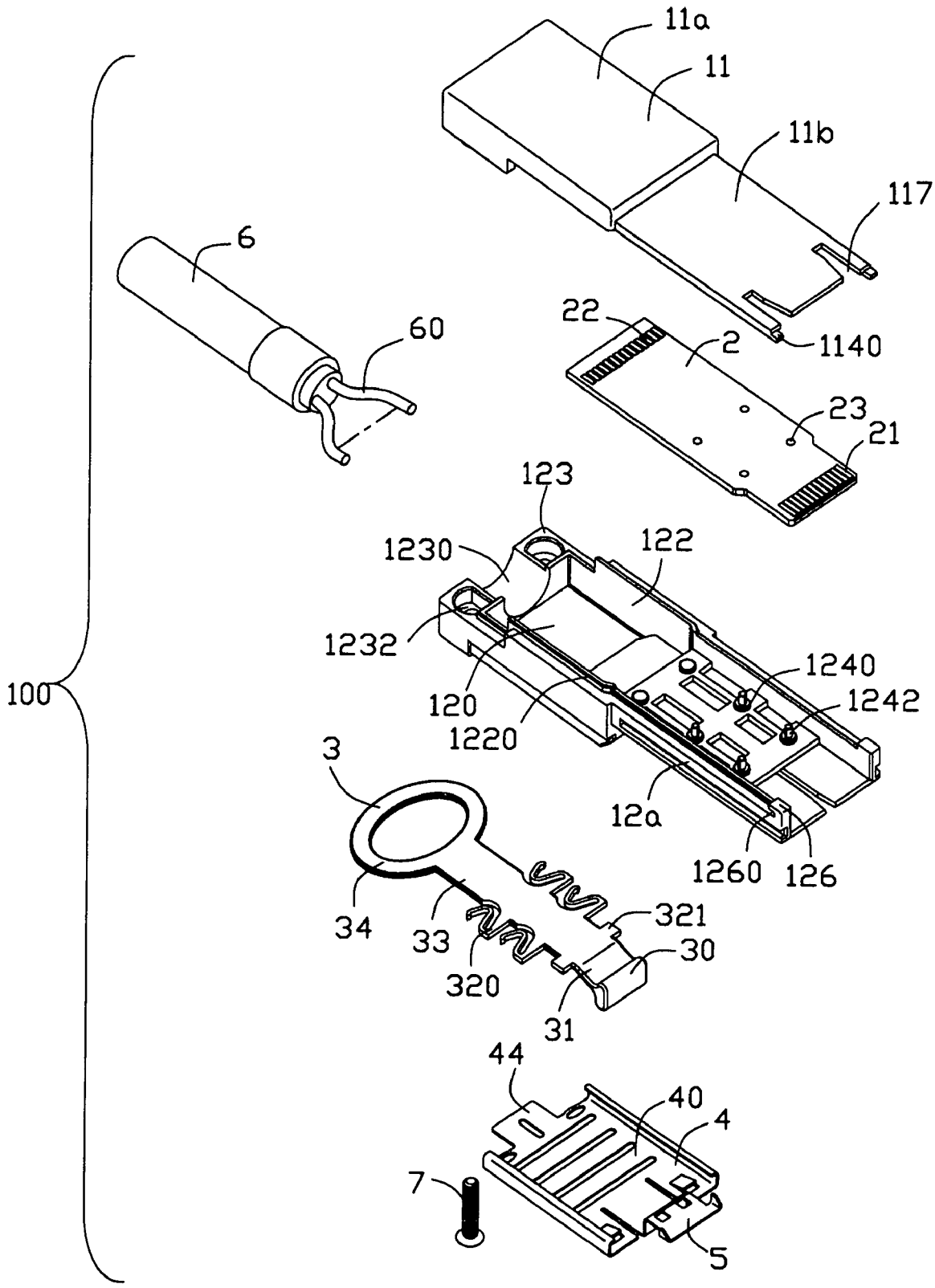
FIG. 2 is a view similar to FIG. 1, but viewed from a different angle.
Figure 3:
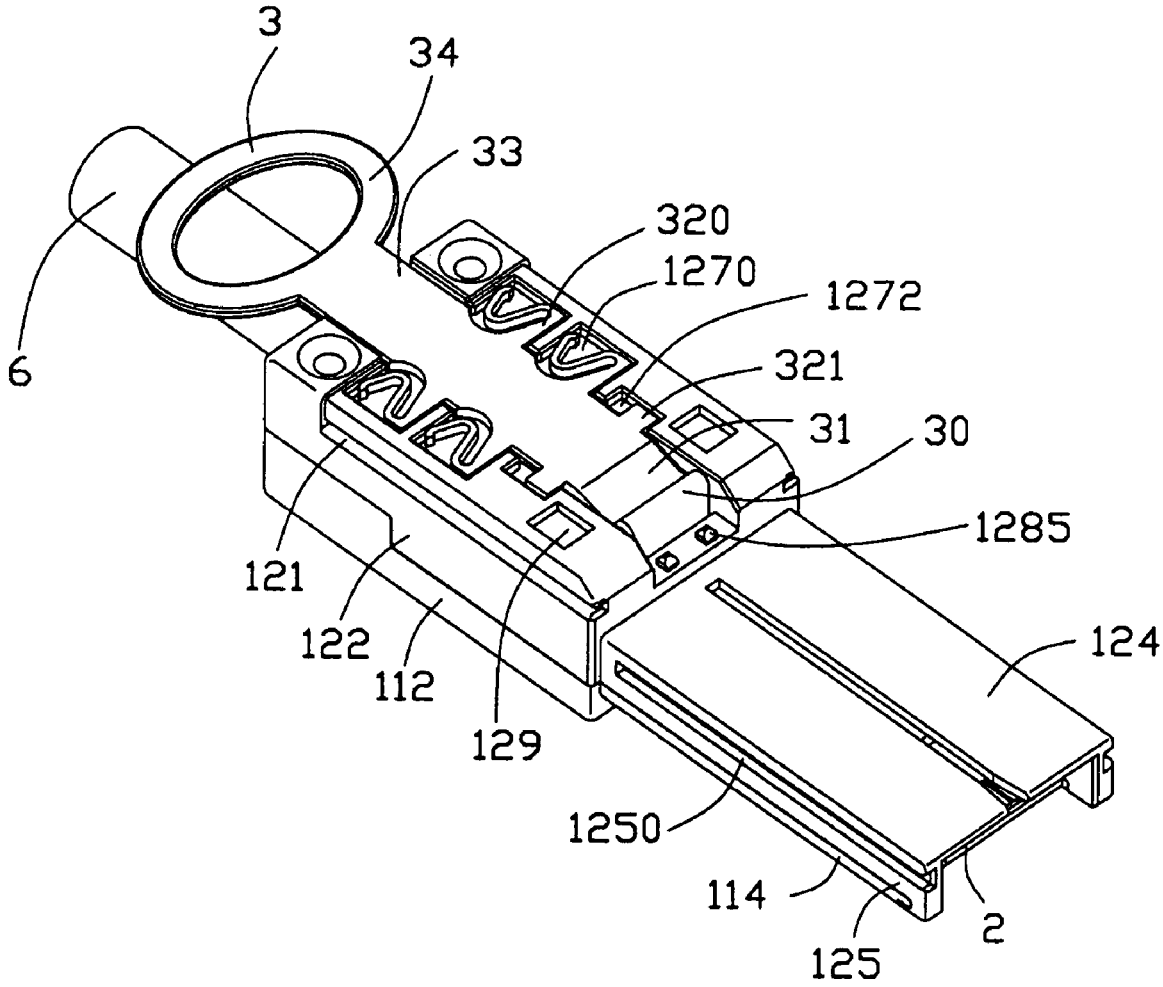
FIG. 3 is a partially assembled view of the cable connector assembly of FIG. 1.
Figure 4:
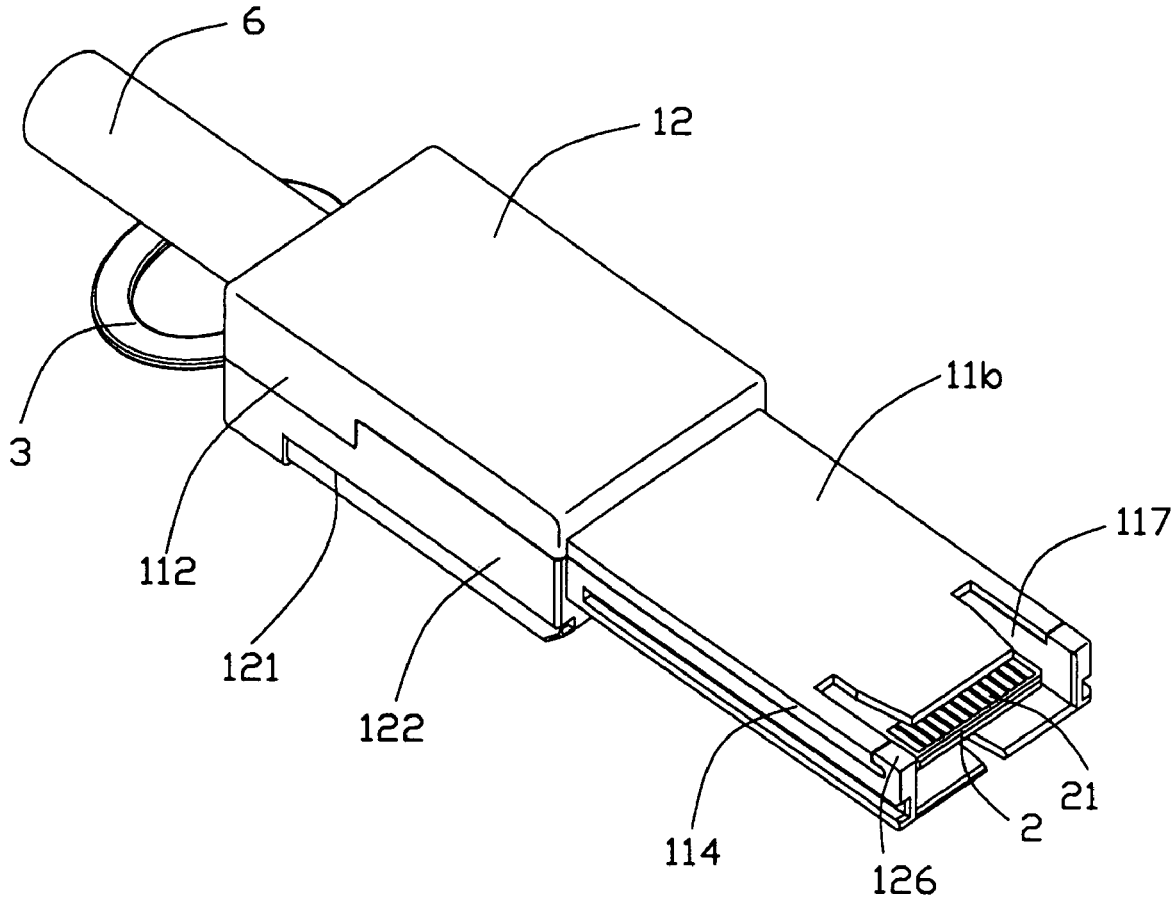
FIG. 4 is a view similar to FIG. 3, but viewed from a different angle.
Figure 5:
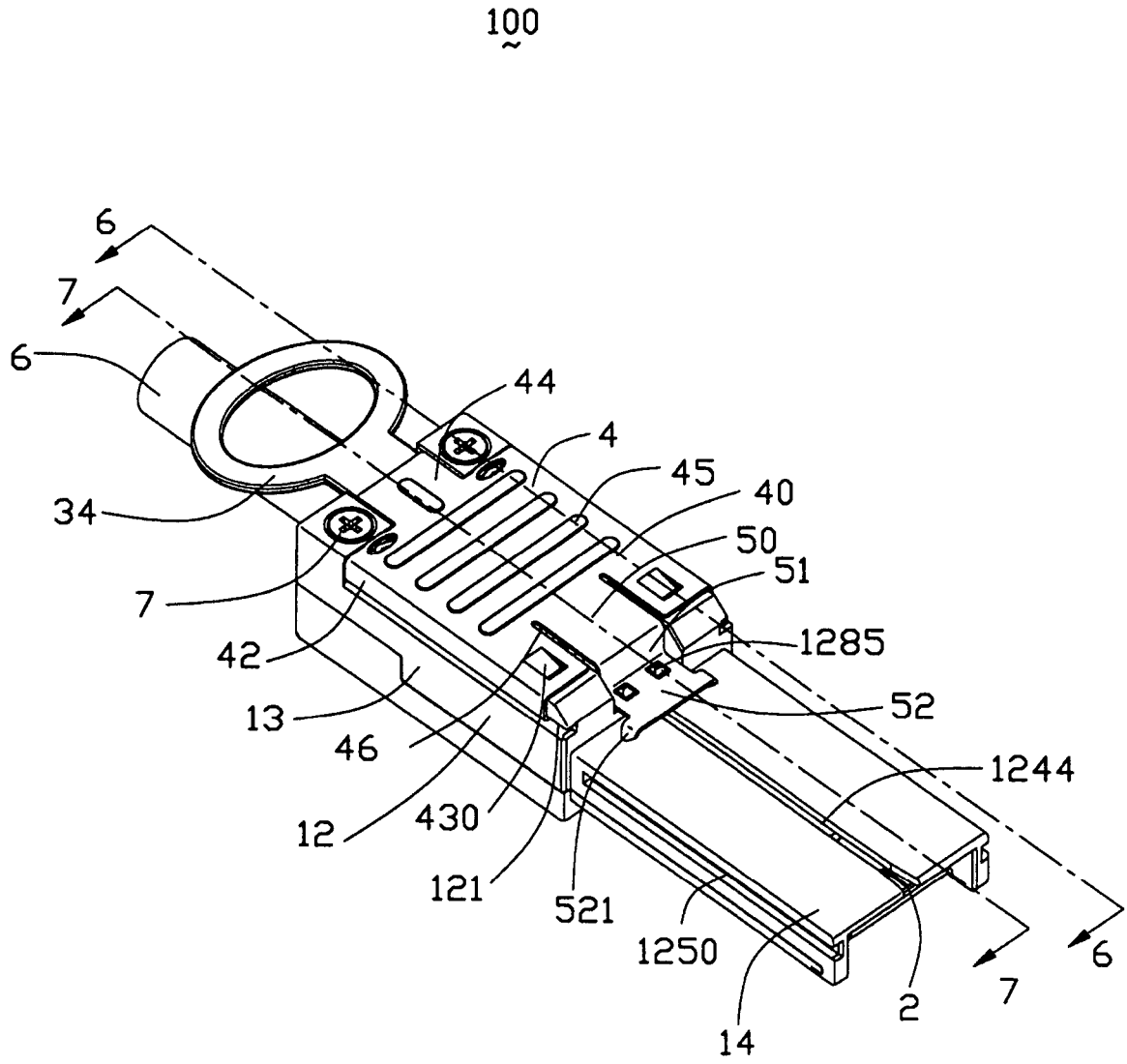
FIG. 5 is an assembled view of the cable connector assembly of FIG. 1.
Figure 6:
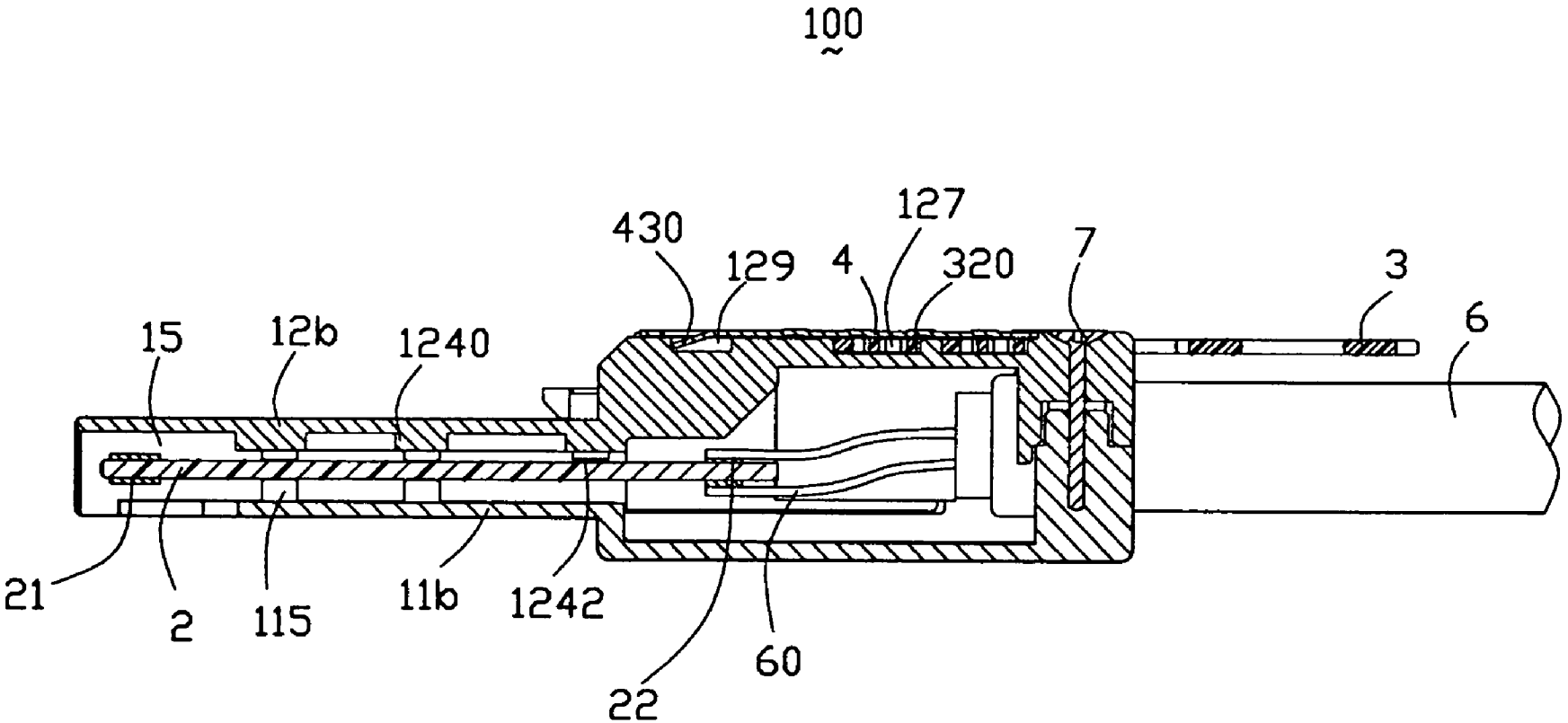
FIG. 6 is a cross-sectional view of FIG. 5 along line 6—6.

Referring to FIGS. 1–2, a cable connector assembly 100 in accordance with the present invention comprises a housing 1, a printed circuit board (PCB) 2 located in the housing 1, a cable 6 electrically connecting with the PCB 2, a conductive shell 4 assembled to the housing 1, a latch member 5 integrally formed with the metal shell 4, and a pulling member 3 cooperating with the latch member 5. The latch member 5 and the pulling member 3 together form a latch mechanism (not labeled) used for latching/unlatching with a complementary connector (not shown).

Please refer to FIGS. 1–2 again, the housing 1 is made of metal material and comprises a base 11, a cover 12 engageable with the base 11 and a receiving space 15 formed between the base and the cover 11, 12. The metal housing 1 also comprises a rectangular base portion 13 and an elongated tongue portion 14 extending forwardly from the base portion 13.

The base 11 comprises a first base section 11*a* and a first tongue section 11*b* extending forwardly from the first base section 11*a*. The first base section 11*a* comprises a first flat portion 110, a pair of first flanges 112 and a first rear wall 113 extending upwardly from opposite side edges and rear edge of the first flat portion 110. The front portions of the first flanges 112 are cut to present the first flanges 112

L-shaped. A first substantially semicircular opening 1130 is defined in the first rear wall 113 and a pair of first screw holes 1312 are defined in the first rear wall 113 and located at opposite sides of the first semicircular opening 1130. A first slit 1120 extends downwardly from a top surface of the first base section 11*a* and into the first flanges 112 and a front portion of the first rear wall 113. The first tongue section 11*b* comprises a first panel 118 formed with a pair of ribs 114 located at opposite sides thereof. Each rib 114 forms a tip end 1140 extending beyond a front edge of the first panel 118. The first panel 118 also forms two pairs of first standoffs 115 spaced arranged thereon, and each first standoff 115 defines a first positioning hole 1150 therein. A pair of U-shape cutouts 117 extend rearward from the front edge of the first panel 118 and respectively locate adjacent to corresponding ribs 1140.

Figure 7:
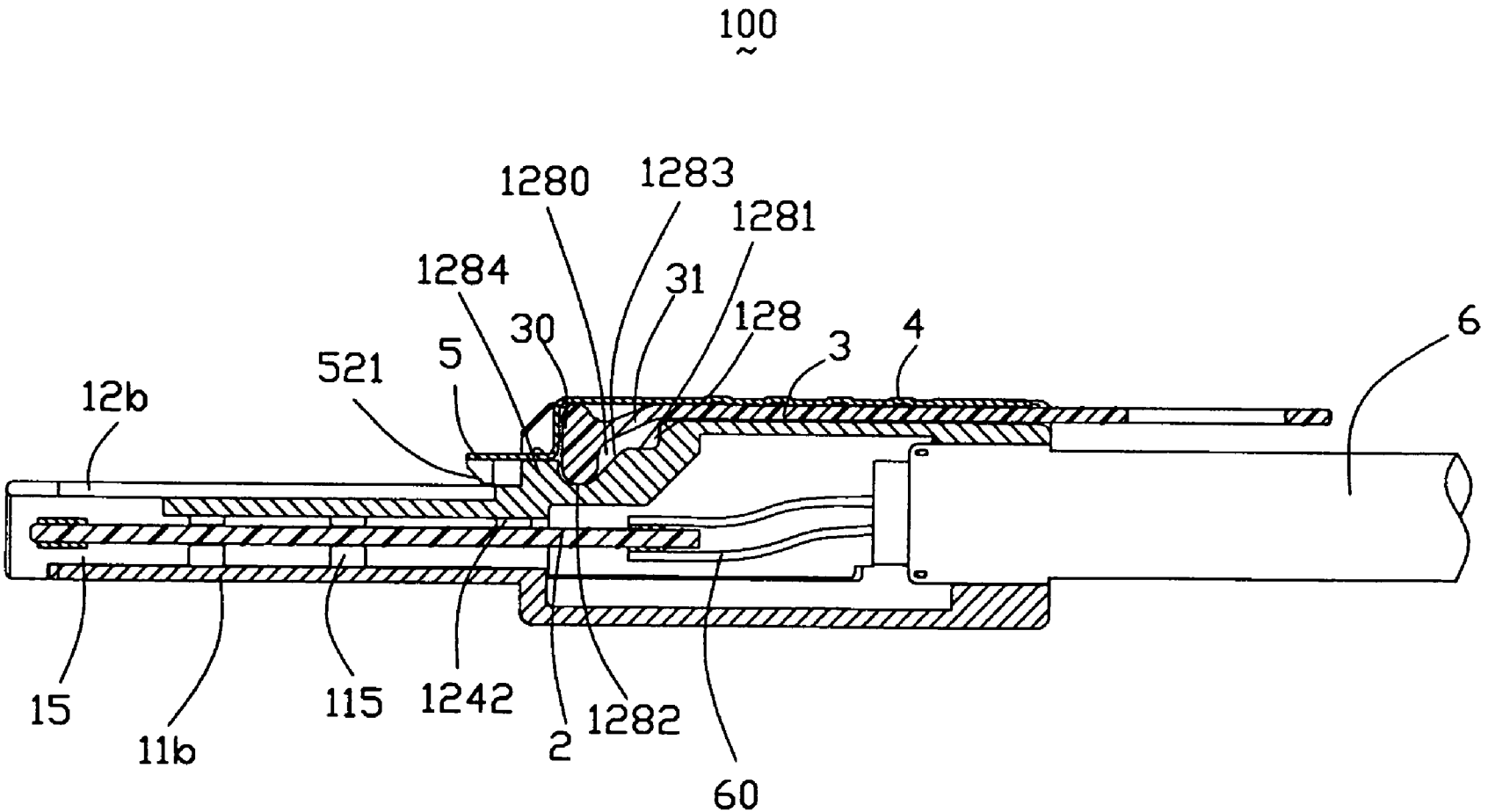
FIG. 7 is a cross-sectional view of FIG. 5 along line 7—7.

The cover 12 comprises a second base section 12*a* and a second tongue section 12*b* extending forwardly from the second base section 12*a*. The second base section 12*a* comprises a second flat portion 120, a pair of second flanges 122 and a second rear wall 123 extending downwardly from opposite side edges and a rear edge of the second flat portion 120. The rear portions of the second flanges 122 and the second rear wall 123 are cut to present the second flanges 122 L-shaped. A second substantially semicircular opening 1230 is defined in the second rear wall 123. A pair of second screw holes 1232 are defined through the second rear wall 123 and locate at opposite sides of the second semicircular opening 1230. A cutout 1233 is further defined on top side of the second rear wall 123 between the pair of second screw holes 1232. Corresponding to the first slit 1120 of the base 11, a continuous protruding ridge 1220 integrally extend downwardly from inner edges of the second flanges 122 and the second rear wall 123. A pair of first channels 121 are respectively defined in opposite sides of the second base portion 12*a* extending from a front edge of the second flat portion 120 to the second rear wall 123. The second flat portion 120 defines a first recess section 127 designated to engage with the pulling member 3. The first recess section 127 is in communication with the cutout 1233 and consists of different-size first and second recesses 1270, 1272, and a deeper and narrower second recess section 128 formed in a front portion of the second flat portion 120 to communicate with a front surface of the second flat portion 120. A deeper slit 1280 is defined in the front portion of the second flat portion 120 and extends in a direction perpendicular to that of the second recess section 128 to communicate with the second recess section 128. A transversely-extending bar 1284 is formed at a front end of the second recess section 128 with a pair of projections 1285 arranged thereon. As shown in FIG. 1 and FIG. 7, the second recess section 128 has a bottom surface (not labeled) formed with a first flat surface 1281 adjacent to the first recess section 127, a second flat surface 1282 near the bar 1284 and a rearwardly inclined actuating surface 1283 connecting with the first and second flat surface 1281, 1282. A pair of snapping pit 129 are defined in the top surface of the second base portion 12*a* and locate at opposite sides of the second recess section 128.

The second tongue section 12*b* comprises a second panel 124 formed with a long keyway 1244 in a middle thereof and a pair of side walls 125 extending downwardly from opposite sides of the second panel 124. A pair of second channels 1250 are defined in corresponding side walls 125 opened toward outside for guiding an insertion of a complementary connector (not shown). A pair of protrusions 126 extend rearward from a front surface of the second tongue section 12*b* and respectively locate below the side walls 125 to form a pair of gaps 1260 therebetween. The second panel 124 forms an enhancing portion (not labeled) on a bottom surface thereof for enhancing the strength thereof and three pairs of second standoffs 1240 are symmetrically arranged on the enhancing portion with two pairs of second standoffs 1240 formed with posts 1242 extending downwardly therefrom. The first and second standoffs 115, 1240 with the first positioning holes 1150 and the posts 1242 are served as first engaging means of the housing 1. The first engaging means is not limited to the structures described above, it also can be protrusions protruding from the first and second tongue sections 11*b*, 12*b*, or recesses recessed from the first and second tongue sections 11*b*, 12*b*.

The PCB 2 is formed with a plurality of first conductive pads 21 aligned at a front end thereof and a plurality of second conductive pads 22 aligned at an opposite rear end thereof with different amount from that of the first conductive pads 21. The first and second conductive pads 21, 22 electrically connect with one another through inner traces disposed in the PCB 2. Two pairs of holes 23 are symmetrically arranged on the PCB 2 adjacent to the first conductive pads 21. The holes 23 are served as second engaging means of the PCB 2. The second engaging means is also not limited to the structures described above, it can be standoffs with holes to receive the respective protrusions of the first engaging means of the housing 1, or different-shape projections formed on opposite surfaces of the PCB to be received in the recesses of the first engaging means of the housing 1.

The pulling member 3 is made by insulative material and comprises a cooperating portion 30 with an enlarged head, a sloped connecting portion 31, an elongated intermediate portion 33 extending rearward form the connecting portion 31 and formed with interference portion 32, and a ring-shape operating portion 34 formed at a rear end of the intermediate portion 33. The interference portion 32 comprises a pair of stop sections 320 formed at opposite sides of the intermediate portion 33 and located adjacent to the connecting portion 31 and two pairs of elastic sections 321 formed at middle portion of the intermediate portion 33. The cooperating portion 30 in the preferred embodiment of the present invention is configured to be vertically, fittingly disposed in the deeper slit 1280 of the cover 12.

The conductive shell 4 comprises a body portion 40 formed with a plurality of bars 45 on a top surface for increasing friction and a pair of L-shape lateral walls 42 extending downwardly from opposite sides of the body portion 40. A retention portion 43 is defined at front portion of the body portion 40. In the preferred embodiment, the retention portion 43 is formed with a pair of spaced downwardly protruding spring tabs 430. The conductive shell 4 comprises a positioning tab 44 rearwardly extending from a rear edge of the body portion 40.

The latch member 5 is a cantilever-type member integrally formed with the conductive shell 4. The front portion of the conductive shell 4 is interrupted by a pair of narrow slit 46 and thus forms a deflecting portion 50 providing biasing force to the latch member 5. The latch member 5 further comprises a connecting portion 51 downwardly bent from the deflecting portion 50 and a flat engaging portion 52 latching with the complementary connector. The engaging portion 52 defines a pair of rectangular holes 520 at a rear portion thereof adjacent to the connecting portion 51 and a pair of latches 521 bending downwardly from opposite sides of the front edge thereof.

Referring to FIGS. 1–4 and 6, in assembly, conductors 60 of the cable 6 are respectively soldered to the second conductive pads 22 of the PCB 2. The PCB 2 with the cable 6 is located on the first standoffs 115 of the base 11 with the holes 23 aligned with the first positioning holes 1150 and the cable 6 is located in the first semicircular opening 1130 of the base 11. The cable connector assembly 100 of the present invention may have a cable holder (not shown) grasping a metal braiding area exposed outside of the cable 6 to provide strain relief to the cable 6. The cover 12 is assembled to the base 11 and the PCB 2 with the posts 1242 protruding through the holes 23 and the first positioning holes 1150 to position the PCB 2 in the receiving space 15 of the housing 1. The PCB 2 is sandwiched between the base 1 and the cover 12 by the first and second engaging means engaging with each other. The protruding ridge 1220 of the cover 12 is received in the first slit 1120 of the base 11 and the pair of tip ends 1140 received in the gaps 1260, thus, the base 11 and the cover 12 are also securely assembled together. The first and second screw holes 1132, 1232 combine into a screw receiving space (not labeled).

Referring to FIG. 7 in conjunction with FIGS. 1–6, the pulling member 3 is firstly pressed to the cover 12. The cooperating portion 30 of the pulling member 32 is received in the deeper slit 1280 of the cover 12, and the intermediate portion 33 with the interference portion 32 are received in the first recess section 127. The stop sections 321 and the elastic sections 320 are respectively received in the different-size first and second recesses 1270, 1272. The conductive shell 4 is finally assembled to the second base section 12*a* of the cover 12 with the L-shape lateral walls 42 slideably received in the first channels 121 of the cover 12 along a front-to-back direction until the rear edge of the conductive shell 4 abuts against the second rear wall 123. The positioning tab 44 of the shell 4 is positioned in the cutout 1233. The spring tabs 430 respectively snap into the corresponding snapping pits 129 of the cover 12 for preventing forward movement of the conductive shell 4. The projections 1285 of the cover 12 are respectively received in the rectangular holes 520 and the latches 521 exposed above the second tongue section 12*b*.

When the complementary connector mates with the cable connector assembly 100 of the present invention, contacts of the complementary connector may electrically connect with the first conductive pads 21 of the PCB 2 with corresponding structure thereof latches with the latches 512 of the latch member 5. When the cable connector assembly 100 disengages from the complementary connector, a rearward pulling force exerts to the operating portion 34 of the pulling member 3 to actuate the pulling member 3 rearward move with the elastic sections 320 and the stop sections 322 sliding in the second and first recesses 1272, 1270. The cooperating portion 30 also rearward moves along the sloped actuating surface 1281 of the cover 12, thus upwardly deflecting the deflecting portion 50 of the latch member 5, consequently, the latches 521 of the latch member 5 moved upwardly to unlatch from the complementary connector. After the rearward pulling force is removed, restore force of the elastic sections 320 actuates the pulling member 3 to move forwardly to its original position, and thus, the latch member 5 also reverts to its original position.

A pair of screws 7 are screwed through the second screw holes 1232 of the cover 12 and the first screw holes 1132 of the base 11 to secure the base 11 and the cover 12 together.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly for mating with a complementary connector along a front-to-back direction, comprising:

a housing defining a receiving space and a top surface;

a plurality of contacts received in the receiving space of the housing;

a cable electrically connecting with the contacts;

a pulling member assembled to the top surface of the housing;

a conductive shell assembled to the housing and comprising a body portion essentially vertically shielding the puling member; and a latch member extending integrally from the conductive shell and capable of being actuated by the pulling member for being deflected in a vertical direction perpendicular to said front-to-back direction, so as to latch or unlatch with regard to the complementary connector.

2. The cable connector assembly as claimed in claim 1, wherein the latch member comprises a deflecting portion connecting with the conductive shell and an engaging portion extending forwardly from the deflecting portion and formed with a latch vertically extending from the engaging portion for latching with the complementary connector.

3. The cable connector assembly as claimed in claim 2, wherein the deflecting portion locates above the top surface of the housing, and wherein the engaging portion engages with the housing and locates in a surface parallel to the top surface of the housing.

4. The cable connector assembly as claimed in claim 2, wherein the latch member comprises a connecting portion connecting the deflecting portion with the engaging portion.

5. The cable connector assembly as claimed in claim 2, wherein the pulling member comprises a cooperating portion capable of actuating the deflecting portion of the latch member and an operating portion exposed outside of the conductive shell capable of being pulled rearward.

6. The cable connector assembly as claimed in claim 5, wherein the housing forms a sloped actuating surface, and wherein the cooperating portion of the pulling member slide along the sloped actuating surface to actuate the deflecting portion of the latch member vertically deflected, and thus actuating the latch of the engaging portion to deflect in said vertical direction to unlatch from the complementary connector.

7. The cable connector assembly as claimed in claim 6, wherein the housing defines a slit vertically extending from the top surface thereof and locating adjacent to the sloped actuating surface, and wherein the cooperating portion of the pulling member is received in the slit of the housing and touching with a bottom surface of the deflecting portion of the latch member.

8. The cable connector assembly as claimed in claim 5, wherein the housing forms a recess on the top surface thereof, and wherein the pulling member forms an elastic section slidably received in the recess for providing restore force to the pulling member.

9. The cable connector assembly as claimed in claim 1, wherein the housing is made of metal material and the pulling member is made of insulative material.

10. The cable connector assembly as claimed in claim 1, wherein the housing defines a pair of opposite channels on opposite lateral sides thereof, and wherein the conductive shell comprises a pair of lateral walls on opposite sides of the body portion thereof slidably received in the corresponding channels of the housing.

11. The cable connector assembly as claimed in claim 2, wherein the conductive shell forms a pair of spring tabs thereon latching with corresponding portion of the metal housing for preventing a forward movement of the conductive shell relative to the housing.

12. The cable connector assembly as claimed in claim 11, wherein the deflecting portion of the latch member locates between the pair of spring tabs of the conductive shell, and wherein the deflecting portion and the pair of spring tabs are separated from each other by a pair of slits such that the deflecting portion is able to be deflected in a vertical direction perpendicular to the front-to-back direction.

13. The cable connector assembly as claimed in claim 1, wherein the housing is formed by a base and a cover coupled with the base.

14. The cable connector assembly as claimed in claim 13, wherein the base and the cover are combined together by a screw.

15. The cable connector assembly as claimed in claim 1, further comprising a printed circuit board, and wherein the contacts are first and second conductive pads formed on front and rear ends of the printed circuit board.

16. The cable connector assembly as claimed in claim 15, wherein the housing forms first engaging means exposed into the receiving space, and wherein the printed circuit board forms second engaging means cooperating with the first engaging means to retain the printed circuit board to the housing.

17. The cable connector assembly as claimed in claim 15, wherein the amount of the first conductive pads is not equal to that of the second conductive pads.

18. The cable connector assembly as claimed in claim 1, wherein housing comprises a base portion and a tongue portion extending from the base portion, and wherein the conductive shell and the pulling member are respectively assembled to the base portion of the housing.

19. A cable connector assembly comprising:

a housing defining a mating port in a front portion;

a plurality of conductors disposed in the mating port for mating with a complementary connector;

a cable including a plurality of wires respectively electrically connected to the corresponding conductors;

a metallic shell enclosing at least a portion of the housing and including a latch member integrally formed therewith; and a moveable actuator associated with the housing and including a cooperating portion engaged with the latch member so as to deflect the latch member upon movement of said actuator.

* * * * *